United States Patent [19]

Campbell, Jr.

[11] 4,105,812

[45] Aug. 8, 1978

[54] SURFACE FINISH FOR STATUARY

[76] Inventor: E. Calvin Campbell, Jr., 261 - 17th St., West Babylon, Long Island, N.Y. 11704

[21] Appl. No.: 768,405

[22] Filed: Feb. 14, 1977

[51] Int. Cl.[2] ..... B44C 3/06

[52] U.S. Cl. ..... 428/15; D11/159; 35/26; 156/61; 428/16; 428/542; 428/676; 428/677; 428/687

[58] Field of Search ..... 29/460; 35/26; 40/126 R; 46/115, 116, 123, 127; 156/82, 61; D11/131, 159; 428/3, 15, 16, 542, 676, 677, 687, 31

[56] References Cited

U.S. PATENT DOCUMENTS

| | | | |
|---|---|---|---|
| 378,682 | 2/1888 | Herrick | 428/16 |
| 1,764,692 | 6/1930 | Rubenstein | 428/16 X |
| 1,804,279 | 5/1931 | Schnell et al. | 428/31 X |
| 2,153,663 | 4/1939 | Foster | 428/16 |
| 2,372,761 | 4/1945 | Boyd | 156/82 X |
| 2,755,542 | 7/1956 | Boegehold | 29/460 |
| 2,828,561 | 4/1958 | Zinn | 428/16 X |
| 3,762,883 | 10/1973 | Shepard et al. | 428/677 X |

*Primary Examiner*—George F. Lesmes
*Assistant Examiner*—Henry F. Epstein
*Attorney, Agent, or Firm*—Fishburn, Gold & Litman

[57] ABSTRACT

An article of statuary and a decorative surface finish therefor comprises a shaped body having an outer surface, and a thin wall constructed of a ferrous metal. A plurality of brass nodules are brazed to selected portions of the outer surface in an irregular manner, and are shaped to form a rough finished surface. The remainder of the outer surface is provided with spaced, flame scorched regions, each having a variegated coloration to produce a patina effect.

13 Claims, 6 Drawing Figures

GROUND BRASS NODULE

SMOOTH BRASS NODULE

GROUND STEEL

PLAIN STEEL SUBSTRATE

BLACKENED STEEL

COPPER AREA

BRASS PLATE

TARNISHED BRASS PLATE

RESOLIDIFIED COPPER

SURFACE FINISH FOR STATUARY

This invention relates to a surface finish for ferrous metal sheets, and in particular to a rough, irregular, decorative finished surface for articles of statuary.

The primary objects of the present invention are: to provide an article and a decorative surface therefor having a plurality of brass nodules arranged in an irregular manner on the outer surface of the article to produce a rough, attractive finish; to provide such an article wherein the surface thereof includes a plurality of spaced, flame scorched regions, each having a variegated coloration to produce a patina effect; to provide such an article wherein a shaped article body is constructed of polished steel to alleviate the need for flux in bonding the brass nodules thereto; to provide such an article wherein the polished steel includes a thin coating of brass plated to the outer surface thereof for varied article coloration; and to provide such an article which is economical to manufacture, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features thereof.

Figure 1:
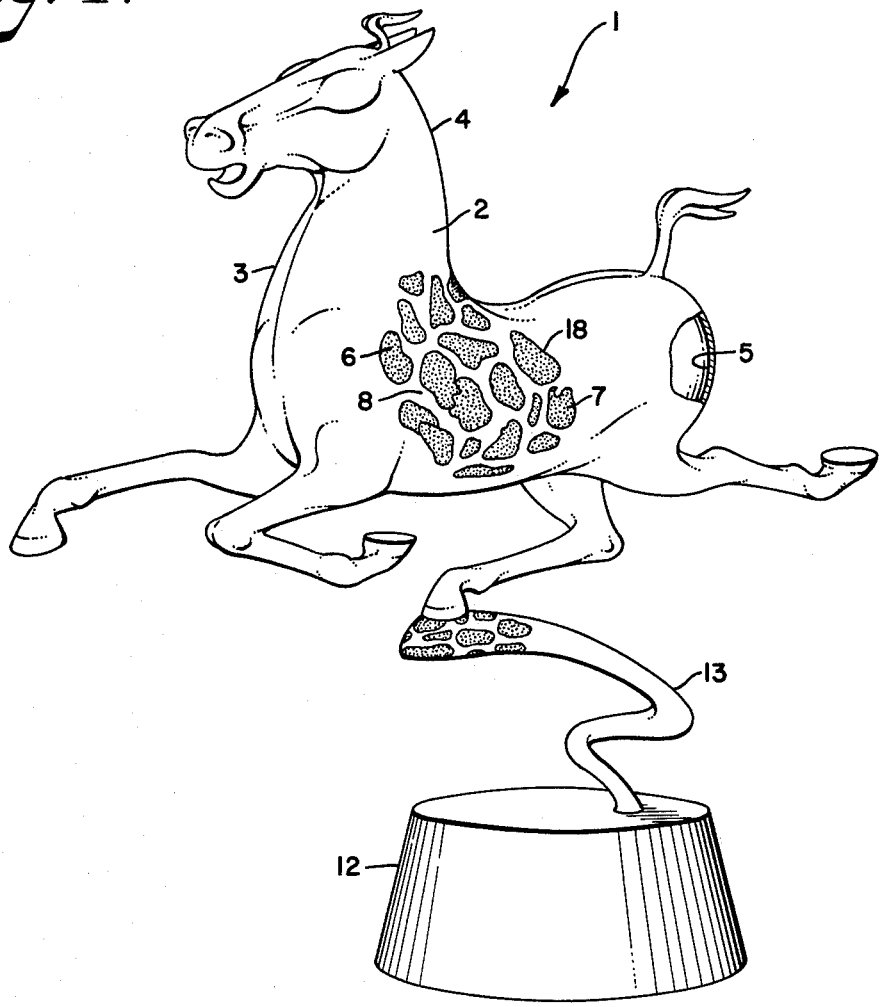
FIG. 1 is a perspective view of an article of statuary and a surface finish covering a medial portion thereof embodying the present invention, with a portion thereof broken away to reveal interior construction.
Figure 3:
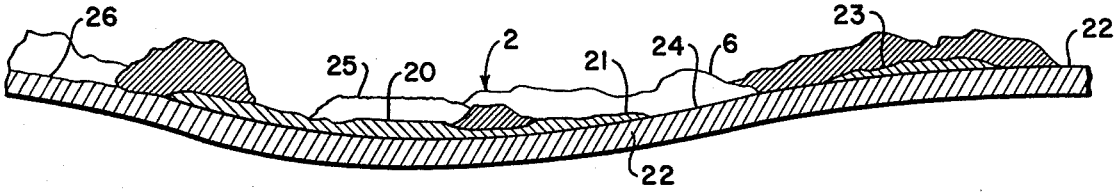
FIG. 3 is a fragmentary vertical cross-sectional view of the article taken along line 3—3, FIG. 2.
Figure 2:
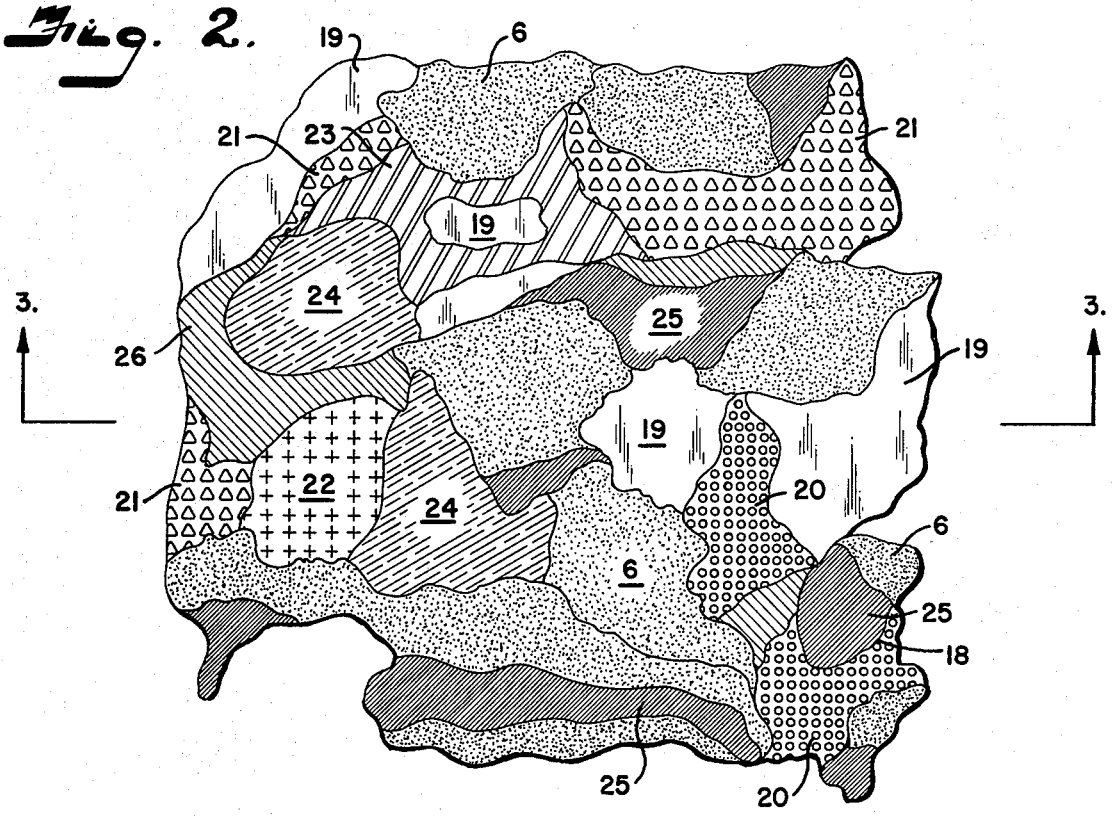
FIG. 2 is an enlarged fragmentary side elevational view of the article.

Referring more in detail to the drawings:

The reference numeral 1 generally designates an article of statuary having a decorative surface finish 2 embodying the present invention thereon. The statue comprises a shaped body 3 having an outer surface 4, and a thin wall 5 constructed of a ferrous metal. A plurality of brass nodules 6 are brazed to selected portions of the outer surface 4 in an irregular manner, and are shaped to form a rough finished surface. The remainder of the outer surface 4 is provided with spaced, flame scorched regions 8, each having a variegated coloration to produce a patina effect.

In the statue illustrated in FIG. 1, only a medial portion thereof is shown with surface finish for convenience in drawing. It is to be understood, however, that the present invention contemplates finishing a portion or the entire outer surface of the structure. Further, the illustrated statue 1 is in the shape of a horse, and is attached to and supported by a base or pedestal member 12. The pedestal is of sufficient size and weight, and is positioned along or adjacent to the statue's center of gravity, to securely support the statue thereon, and in this example includes a linking member 13 having one end welded to a foot portion of the statue and the other end attached to a carved wood base.

The body of the statue illustrated in FIG. 1 is constructed of a mild, light gauge, soft rolled steel having a thin coating of brass plated to at least the outer surface thereof. A steel thickness in the range of 0.0075 – 0.0010 inches, and brass plate thickness in the nature of 0.0001 inches have been successfully used and proven quite satisfactory. However, it is to be understood that other steel and plate thicknesses may be used.

A plurality of brass nodules 6 are brazed preferably by flame welding, to selected portions of the outer surface 4 of the statuary in a dispersed and irregular manner, and form an uneven or rough decorative surface finish 7. In this example, the brass nodules are attached to the outer surface of the statue without using any cleaning flux, thereby avoiding the formation of white, salt-like residue or precipitates on the outer surface of the body. For purposes of description, the selected portions of the outer surface 4 on which the nodules 6 are disposed, collectively define a "first" area. The remainder of the outer surface defines a "second" area. A plurality of scorched outer surface regions are disposed in an irregular manner upon the second area and are generally randomly associated with marginal portions 18 of the nodules, and present a relatively smooth exterior surface of variegated coloration. The first and second areas cooperate to present a complex, irregular blend of multivariegated coloration, finish and depth over a substantial extent or area. The unheated brass plate 19 has a shiny luster and a bright gold coloration. As the brass plate is heated, the same is first tarnished or oxidized slightly as at area 20, and then the zinc contained therein is oxidized and driven out of the alloy leaving a copper area 21 with a dull, satin luster, and a pink tint. Further heat causes the remaining plate to liquify or melt off of the steel substrate, and tend to run downwardly therefrom toward the ground. This process creates areas of plain steel substrate 22, and regions of resolidified copper based plate metal 23, which then comprise primarily reddish colored copper inasmuch as the zinc element in the brass has been previously oxidized and driven therefrom. Additional heat applied to the plain steel substrate causes such areas 24 to become dull, blackened, blue and purple in appearance as the carbon therein is oxidized and other heat caused reactions and mechanisms occur. In the illustrated structure, unwanted metal has been removed from the statue 1 by means such as filing, grinding or the like, thereby creating shiny areas having minute ridges or unidirectional scratches therein, and resulting in bright yellow areas 25 where the brass has been ground, and brightened silver areas 26 where the grinding has extended into the steel substrate.

Figure 4:
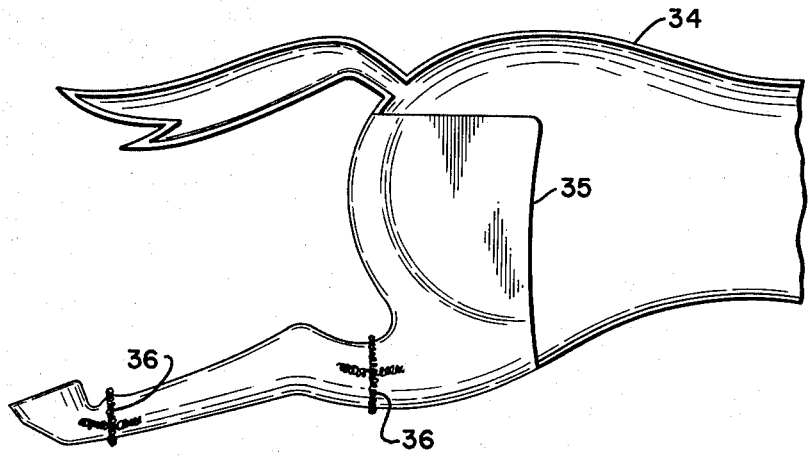
FIG. 4 is a fragmentary side elevational view of the article in a disassembled condition.
Figure 5:
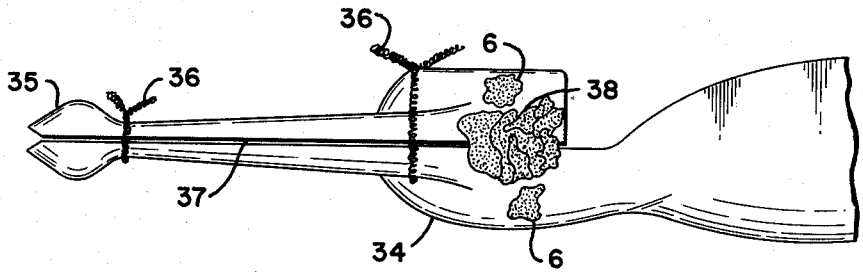
FIG. 5 is a fragmentary bottom plan view of the article in the disassembled condition of FIG. 4.

A method embodying the present invention for constructing an article of statuary and a decorative surface finish therefor, comprises providing thin sheets of brass plated steel from which various body segments are cut. As illustrated in FIGS. 4 and 5, the statuary 1 is formed of a pair of laterally mating segments, with each exposed leg being of a two-part construction to form a hollow structure. The sheet material is first cut in accordance with the proper blank size, and is then formed into the associated statue member, such as the side 34 and inside leg 35 illustrated in FIGS. 4 and 5. The various members of the article are then assembled and retained in position by means such as wire clamps 36. The various body segments are then joined permanently by means such as brazing along each of the seams 37. This brazing is preferably performed with a flame torch, and forms a protruding brass portion 38 along that section of the surface of the body segments. The brass nodules 6 are then brazed to selected portions of the outer surface such that the nodules are dispersed thereon, are disposed in an irregular manner, match with the brass portions 38, and form a rough finished surface which is thin and substantially coextensive with the outer surface of the body and continuous to conceal the seams. Again, this brazing is preferably performed with the flame torch. Concurrently with the brazing of the nodules 6, the operator scorches a plurality of regions within the second area of the outer surface and applies varying amounts of heat to each thereby creating variegated coloration. The wire clamps 36 can be flame cut or melted from the structuring during the brazing step. The ends of selected nodules as well as selected portions of the outer surface are then ground to form the finished surface to the shape desired by the user. The entire finished surface 7 is then burnished and a coating of clear protective material such as lacquer or acrylic sealer is applied thereto to prevent unwanted tarnishing and discoloration. Finally, the finished statuary is attached to the base or pedestal 12.

Figure 6:
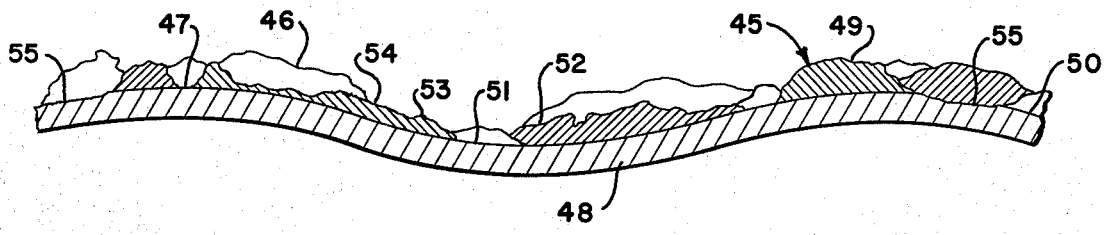
FIG. 6 is a fragmentary vertical cross-sectional view of a second embodiment of the present invention wherein the surface finish is attached directly to a polished steel substrate.

A second embodiment of the present device is shown in FIG. 6 and is generally designated by the reference numeral 45. The surface finish 46 is attached directly to the outer surface 47 of a steel sheet 48, which is polished, and therefore alleviates the need for flux. Similar to the previously discussed structure, brass nodules 49 are brazed to the outer surface 47, and are positioned thereon in a dispersed and irregular manner. The selected application of heat, preferably with a flame torch, to the nodules 49 and the surface 47, produces areas of plain steel substrate 50, blackened, blue and purple steel 51, regions of copper 52 wherein the zinc element of the brass has been oxidized, and resolidified areas of copper 53. The finish is selectively ground to form shiny brass and steel areas 54 and 55 respectively.

It is to be understood that while certain forms of this invention have been illustrated and described, it is not to be limited to the specific form or arrangement of parts herein described and shown, except insofar as such limitations are included in the following claims.

What is claimed and desired to secure by Letters Patent is:

1. In combination, a decorative article and a means forming a surface finish therefor, said combination comprising:

(a) a decorative article body having an outer surface and a thin wall constructed of a ferrous metal;

(b) a plurality of brass nodules in brazed engagement with selected, generally randomly located portions of said outer surface in a dispersed and irregular manner and forming a rough finished exterior surface of variegated coloration; said selected portions collectively defining a first area of said outer surface, and the remainder of said outer surface defining a second area thereof; and (c) a plurality of scorched outer surface regions disposed in an irregular manner upon said second area and generally randomly associated with marginal portions of said nodules and presenting a relatively smooth exterior surface of variegated coloration; said first and second areas cooperatively presenting a complex, irregular blend of multi-variegated coloration, finish and depth over a substantial extent.

2. An article as set forth in claim 1 wherein:

(a) said decorative article is an article of hollow statuary.

3. An article as set forth in claim 2 wherein:

(a) said article body is constructed of a mild, polished sheet steel.

4. An article as set forth in claim 2 wherein:

(a) said wall includes a thin coating of brass plated to said outer surface.

5. An article as set forth in claim 1 wherein:

(a) said ferrous metal is a mild steel with a thin layer of brass plated thereto;

(b) said scorched regions include:

(1) a first section wherein said brass is tarnished;

(2) a second section wherein the zinc in said layer of brass is oxidized;

(3) a third section wherein said layer of brass is melted and flowed therefrom exposing the substrate steel; and (4) a fourth section wherein said substrate steel is heated and thereby discolored into black, blue, and purple portions.

6. A method for decorative surface finishing an article of statuary comprising the steps of:

(a) providing an article body having an outer surface, and having a thin side wall constructed of a ferrous metal;

(b) brazing a plurality of brass nodules to selected, generally randomly located portions of said outer surface, being disposed in an irregular manner thereon, and forming a rough finished exterior surface of variegated coloration; said selected portions collectively defining a first area of said outer surface, and the remainder of said outer surface defining a second area thereof;

(c) scorching a plurality of selected outer surface regions disposed in said second area; said regions being positioned in an irregular and spaced apart manner; each of said regions having a variegated coloration.

7. A method as set forth in claim 6 wherein:

(a) said side wall includes a thin coating of brass plated to said outer surface.

8. A method as set forth in claim 6 wherein:

(a) said brass nodules each have an end thereof protruding outwardly of said body outer surface;

(b) said outer surface of said body defines a body shape; and including (c) grinding the end of selected nodules whereby said rough, finished surface has a shape substantially similar to said body shape.

9. A method as set forth in claim 6 including:

(a) burnishing said rough finished surface after said scorching.

10. A method as set forth in claim 9 including:

(a) coating said finished surface with a clear sealer after said burnishing.

11. A method as set forth in claim 6 wherein:

(a) said body is hollow and contoured, and comprises at least two separable and cooperating portions which mate along a seam; and including (b) brazing said body portions together along said seam by forming a plurality of protruding brass portions therealong concurrently with brazing said nodules to the outer surface; said brass portions matching said nodules whereby said rough finished exterior surface is substantially continuous and conceals said seam.

12. The article of hollow statuary and surface finish therefor resulting from practicing the method of:

(a) providing a hollow body having at least two separable and cooperating portions which mate along a seam; said body having a contoured outer surface defining a body shape, and a thin wall constructed of brass-plated sheet steel;

(b) flame brazing said body portions together along said seam by forming a plurality of protruding brass portions therealong and contemporaneously flame welding brass to selected portions of said outer surface and forming a plurality of outwardly protruding brass nodules thereon; each of said nodules having an outwardlymost disposed portion and being dispersed on said outer surface in an irregular manner to form a rough finished exterior surface; said brass portions matching said nodules whereby said rough finished exterior surface is substantially continuous and conceals said seam; said selected portions collectively defining a first area of said outer surface, and the remainder of said outer surface defining a second area thereof; and (c) scorching a plurality of selected regions disposed in said second area substantially contemporaneously with said brazing and welding; said regions being positioned in an irregular and spaced apart manner; each of said regions having a variegated coloration.

13. An article of statuary and surface finish therefor as set forth in claim 12, including the steps of:

(a) grinding the outwardlymost portion of selected nodules and selected portions of said outer surface;

(b) burnishing said rough finished surface; and (c) coating said finished surface with a clear sealer.

* * * * *